US007973734B2

(12) United States Patent
Strempel et al.

(10) Patent No.: US 7,973,734 B2
(45) Date of Patent: Jul. 5, 2011

(54) APPARATUS AND METHOD FOR COVERING INTEGRATED ANTENNA ELEMENTS UTILIZING COMPOSITE MATERIALS

(75) Inventors: John F. Strempel, Marcellus, NY (US); Edward P. Olszewski, Jr., Syracuse, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 216 days.

(21) Appl. No.: 11/981,016

(22) Filed: Oct. 31, 2007

(65) Prior Publication Data

US 2009/0109116 A1 Apr. 30, 2009

(51) Int. Cl.
*H01Q 1/38* (2006.01)
*H01Q 1/40* (2006.01)
*H01P 11/00* (2006.01)

(52) U.S. Cl. ..... 343/873; 343/872; 343/700 MS; 29/600

(58) Field of Classification Search ..... 343/873, 343/872, 700 MS, 702, 834–836
See application file for complete search history.

(56) References Cited

U.S. PATENT DOCUMENTS 3,713,167 A * 1/1973 David ..... 343/797
4,682,180 A * 7/1987 Gans ..... 343/769
5,181,042 A * 1/1993 Kaise et al. ..... 343/700 MS
5,406,292 A * 4/1995 Schnetzer et al. ..... 343/700 MS
5,463,404 A * 10/1995 Wall ..... 343/700 MS
5,608,414 A * 3/1997 Amore ..... 343/700 MS
5,662,294 A * 9/1997 Maclean et al. ..... 244/219
5,880,694 A * 3/1999 Wang et al. ..... 343/700 MS
5,926,136 A * 7/1999 Ohtsuka et al. ..... 343/700 MS
6,020,855 A 2/2000 Nagy et al.
6,067,053 A * 5/2000 Runyon et al. ..... 343/797
6,114,997 A * 9/2000 Lee et al. ..... 343/700 MS
6,275,157 B1 8/2001 Mays et al.
6,292,144 B1 * 9/2001 Taflove et al. ..... 343/702
6,320,547 B1 * 11/2001 Fathy et al. ..... 343/700 MS
6,812,893 B2 * 11/2004 Waterman ..... 343/700 MS
7,075,485 B2 * 7/2006 Song et al. ..... 343/700 MS
7,099,686 B2 * 8/2006 Ro et al. ..... 455/550.1
7,102,587 B2 9/2006 Benton et al.
7,113,142 B2 * 9/2006 McCarville et al. ..... 343/797
7,122,891 B2 10/2006 Dishongh et al.
7,202,818 B2 * 4/2007 Anguera Pros et al. ..... 343/700 MS
7,271,769 B2 * 9/2007 Asano et al. ..... 343/702
7,636,063 B2 * 12/2009 Channabasappa ..... 343/700 MS
7,667,650 B2 * 2/2010 Tiezzi et al. ..... 343/700 MS
7,884,778 B2 * 2/2011 Wu et al. ..... 343/872
2002/0011955 A1 * 1/2002 Apostolos ..... 343/700 MS
2006/0097949 A1 * 5/2006 Luebke et al. ..... 343/873
2008/0036675 A1 * 2/2008 Fujieda ..... 343/834
2008/0122726 A1 * 5/2008 Levi et al. ..... 343/873
2009/0058731 A1 * 3/2009 Geary et al. ..... 343/700 MS

* cited by examiner

*Primary Examiner* — Rexford N Barnie
*Assistant Examiner* — Crystal L Hammond
(74) *Attorney, Agent, or Firm* — Howard IP Law Group, P.C.

(57) ABSTRACT

The present invention provides an antenna system for transmitting and receiving radar signals comprising a first non-conductive material embedding a plurality of parasitic antenna elements, where the first non-conductive material interfaces a second non-conductive material embedding a plurality of electrical feed elements, and wherein the first non-conductive material covers one or more adjacent interconnecting joints.

20 Claims, 4 Drawing Sheets

APPARATUS AND METHOD FOR COVERING INTEGRATED ANTENNA ELEMENTS UTILIZING COMPOSITE MATERIALS

FIELD OF INVENTION

The present invention relates to the field of embedded antennas such as those used in phased array radar applications.

BACKGROUND

Ground based radars often work in harsh environments where rain, snow, and contaminates in the form of dirt, dust, chemical and biological agents degrade and disable performance. Other disabling forces may come in the form of radiation from nuclear and electronic countermeasures. Typically the radar components are housed in enclosures. However, in addition to maintaining a shield against these potentially disabling forces and events, the enclosures themselves must withstand the deleterious effects of contamination such as water or corrosive decontamination fluids.

Radar antennas are usually mounted on the front end of a radar system, where the effects of these disabling events or forces may be especially severe. In the front or forward position the electronic and mechanical assemblies, assembly housings and associated small openings and joints collect dirt, sand and other debris. Additionally, mounting antenna elements requires holes to be cut in the front surface of enclosures, which after mounting are sealed against the weather and contamination. If a seal fails, contaminates such as water, sand, dirt, debris or corrosive fluids may enter the enclosure and damage the electronics or mechanical assemblies.

FIG. 1, FIG. 2*a* and FIG. 2*b* illustrate the prior art wherein a phased array antenna system 5 is comprised of a number of antenna elements 30 arranged in rows and/or columns 35. When the individual elements 30 are installed in the array 35, the joints 22 (shown as seams in FIG. 2*b*) between them may collect debris as mentioned above. The prior art shown in FIG. 1 and FIG. 2*a* illustrates the use of a patch element 30 consisting of alternating layers 24 of a generally foam material having two conductive sheets 23, 26. Sheet 26 forms the electrical feed patch, typically formed of copper or other conductive material that connects the antenna to the radar processing system. Sheet 23 is separated from the sheet 26 by the layers 24 to form a parasitic patch typically comprised of an aluminum or copper material to improve overall antenna performance. A reliable means for sealing the front surface of the antenna array 5 from harsh environments is needed to prevent damage or failure of the radar system.

SUMMARY OF THE INVENTION

The present invention provides an antenna system for transmitting and receiving radar signals having feed interconnections comprising a first non-conductive material embedding a plurality of parasitic antenna elements, where the non-conductive material interfaces a second non-conductive material embedding a plurality of electrical feed elements, and wherein the first non-conductive also covers one or more adjacent interconnecting joints.

Another embodiment of the invention comprises a system and a method of forming layers of composite material to enclose antenna elements and to seal off the interconnecting joints from the external environment. More particularly, the antenna for transmitting and receiving radar signals comprises a top cover interfacing a first set of layers embedding a plurality of parasitic antenna elements, said first set of layers interfacing a second set of layers embedding a plurality of feed antenna elements, such that the top cover protects the feed antenna elements interconnections from the environment.

The invention also includes a method of maintaining an embedded antenna having a first non-conductive material cover comprising the steps selected from one of: (a) cleaning the cover to remove contamination; (b) removing the cover if contaminated; (c) replacing the cover.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 3:
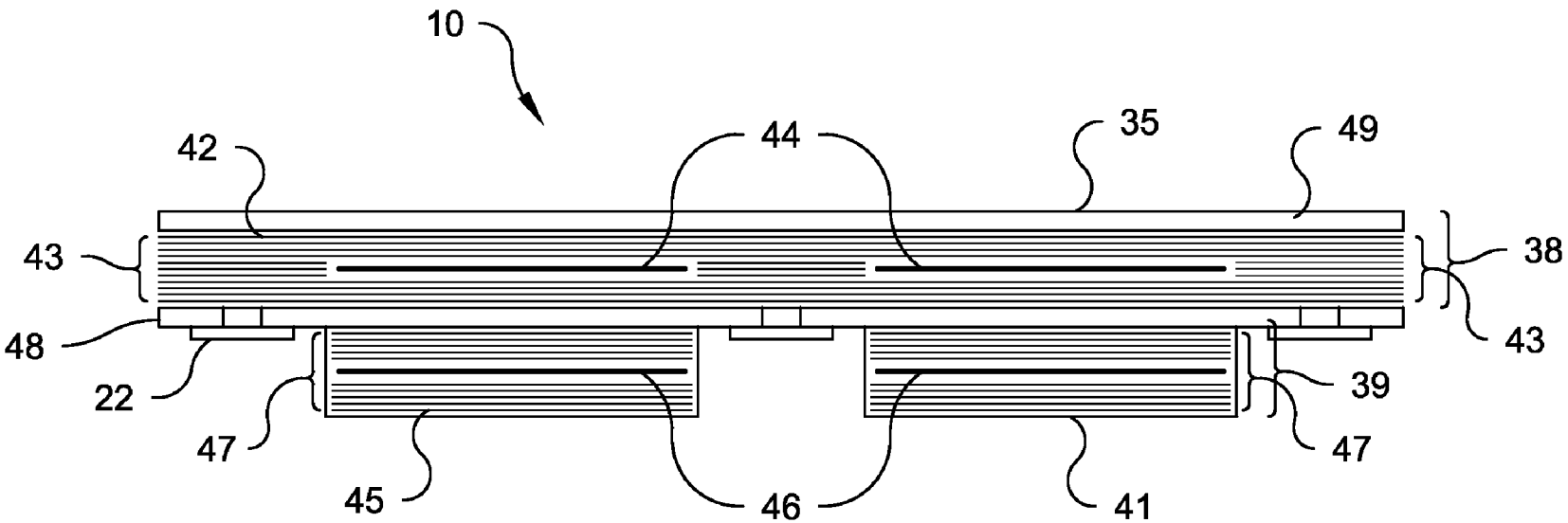
FIG. 3 illustrates adjacent antenna elements having a continuous cover arranged within continuous layers of a non-conductive composite material according to an embodiment of the present invention.

Referring to FIG. 3, the embedded antenna system 10 is constructed from a first set of non-conductive materials 38 that embeds a plurality of parasitic patch antenna elements 44 in the cover of the array. The set of materials 38 also interfaces with a second set of non-conductive materials 39. A cover layer or cover 49, as part of the first non-conductive materials 38, covers at least one adjacent antenna feed interconnecting joint 22. A portion of the non-conductive materials 38 also forms a plurality of parasitic related layers 43. Layers 43 are disposed between the cover layer 49 and an interface layer 48. The second set of non-conductive materials 39 embeds a plurality of antenna feed elements 46. A portion of the non-conductive materials 39 also forms a plurality of the feed related layers 47. The interface layer 48 directly contacts the bottommost one of parasitic layers 43. Feed related layers 47 are disposed between the interface layer 48 and a bottommost layer 45 of the second set of non-conductive materials 39.

The non-conductive material for the layers as described is chosen for mechanical, chemical, and electrical characteristics. Cover layer 49 and parasitic layers 43 cover interconnecting joints 22. Dependent upon the selection of materials the cover 49, as aided by parasitic layers 43, protects the phased array 10 from various forms of environmental assaults as well as offensive countermeasures that would otherwise serve to disable its operation.

In one embodiment of the invention illustrated in FIG. 3, the phased array antenna 10 comprises cover layer 49, layers 43, layer 48 and layers 47 each fabricated from non-conductive composite materials such as by way of example graphite carbon/epoxy, fiberglass/epoxy, polyimide/epoxycarbon/polymide. The selection of the composite material for the layers is based on mechanical properties as reflected by its resilience, strength, flexibility, permeability, as well as electrical properties such as dielectric constant, electrical permeability and conductivity. Cover layer 49 material is additionally chosen for its cleaning ability such as aided by low surface porosity or high degrees of smoothness or its ability to provide proper adhesion for non-conductive coatings such as paint for purposes of camouflage, as well as chemical properties disposed to favorably relate to resistance to environmental contaminants.

The joints 22 form a system of seams 32 (see FIG. 2*b*), which in the embodiment of the invention shown in FIG. 3 are now sealed in the direction of the space into which the radar radiates and from which the radar receives electromagnetic signals.

Figure 2B:
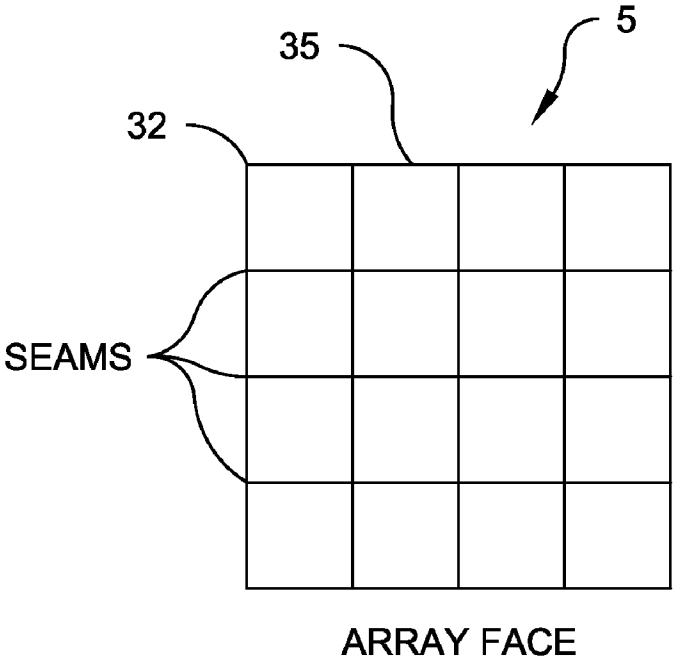
Fig. 2b (Prior Art)
FIG. 2*b* is a front view prior art configuration of the face of a phased array antenna.
Figure 2A:
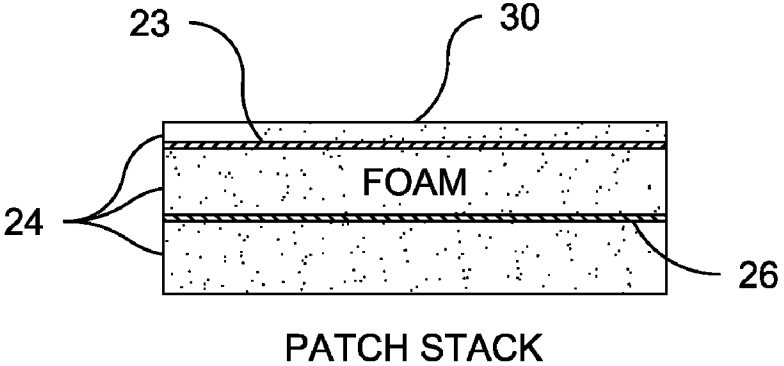
Fig. 2a (Prior Art)
FIG. 2*a* is side view prior art configuration of one antenna patch element.

Parasitic elements 44 typically comprise an aluminum or copper material used to improve the overall antenna performance and are embedded or sandwiched between one or more of the layers 43. By way of example only, the parasitic elements may be chosen form materials such as aluminum, copper, brass, and copper alloys. Copper alloys may or may not be plated of a conductive metal. The top cover 49 protects a balance of the underlying layers 43 of composite material. Additionally cover 49 and layers 43 together protect the joints 22 from contamination arising from the collection of debris in the joints of interconnected antenna elements, such as the seams 32 shown in the prior art (FIG. 2*b*). By placing the parasitic patch elements in the composite array cover, any joints or seams in the array face are protected via the continuous protective outer cover sheet, thereby eliminating the potential for trapped contaminants while providing appropriate electrical performance. Furthermore, since the array cover now contains a composite material including the embedded patch elements, the overall depth of the enclosure 10 is reduced, thereby providing additional volume in the array enclosure for electronics and/or mechanical structures.

Figure 4:
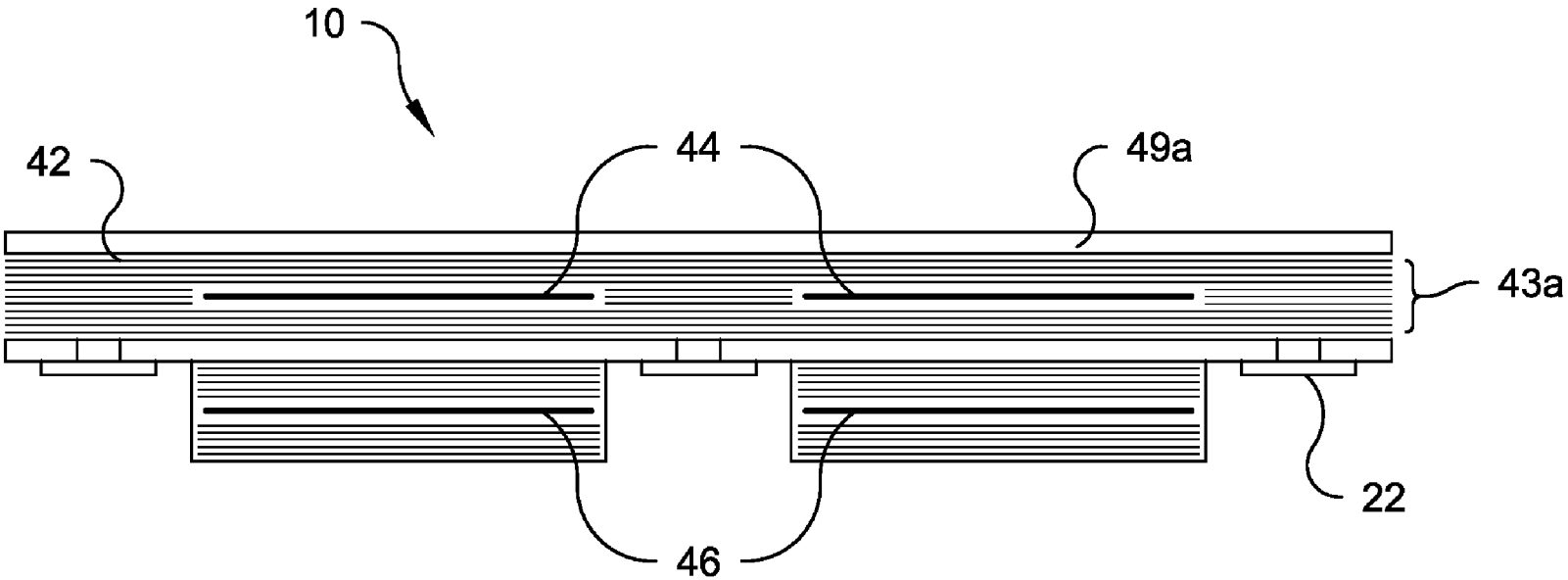
FIG. 4 illustrates an alternate embodiment of adjacent antenna elements having a continuous cover according to an embodiment of the present invention.

FIG. 4 shows an alternate embodiment wherein a cover 49*a* forms a first non-conductive material layer separate and distinct from the balance of the underlying parasitic layers 43*a*. In this embodiment layer 43*a* is interposed between the cover 49*a* and interface layer 48. The layer 49*a* may be composed of a material the same as or different from layers 43*a* and layer 48. In at least one embodiment a layer 42 comprises a bonding material that secures the top layer of layers 43*a* to the bottom surface of cover layer 49*a*. In an alternate embodiment of cover 49 (see, FIG. 3) or cover 49*a* (see, FIG. 4), the covers are removable and replaceable with other suitable covers as may be required or desirable to maintain the antenna system.

In yet another embodiment as shown in FIG. 4 cover 49*a* may be fabricated from the class of materials including graphitecarbon/epoxy, fiberglass/epoxy, polyimide/epoxycarbon/polymide), but distinct from the selected material of underlying parasitic layers 43*a*. In choosing cover 49*a* material, consideration is given to its resilience, strength, flexibility, permeability, resistance to environmental factors. By way of example and not limitation the cover 49*a* may be fabricated from material having a relatively smooth and non-porous surface such as an acrylic fabrication, polyester, polyethylene and epoxy resins, or an aramid fiber such as Kevlar® brand fiber.

Referring again to FIG. 3, each embedded parasitic element 44 is separated from a corresponding embedded feed patch 46 by the dielectric material properties of the first and second sets of non-conductive material layers 38 and 39 respectively. All layers of materials 38, 39 may be optionally selected from the same material or from materials of a type different from one another. Furthermore, interface layer 48 may act as a separator sheet to optionally separate each set of layers 43 from layers 47. In at least one embodiment the layer 48 comprises a bonding material that secures the bottom layer of layers 43 to the top layer of layers 47. Optionally a separator sheet such as layer 48 may be fabricated from a generally foam material or from composite materials from the class graphite/epoxy, fiberglass/epoxy, polyimide/epoxy or a metallic sheet, such as aluminum or copper, depending upon the antenna application or performance requirements.

Each electrical feed patch 46 is typically constructed from copper and connects the antenna 10 system to the radar processing system (not shown). Each connection for the electrical feed patch 46 separately extends through at least a portion of the layers 47. The dielectric material of feed patch layer 47 may be fabricated from non-conductive foam or a composite material from the class graphitecarbon/epoxy, fiberglass/epoxy, polyimide/epoxycarbon/polymide layered so as to embed the electrical feed patch 46. The multiple layer 47 interface may optionally include the layer 48. A grounded metallic or metallized cover 41, such as aluminum typically enshrouds the exposed five sides of the layer 47 interposing the electrical feed patch 46.

Figure 1:
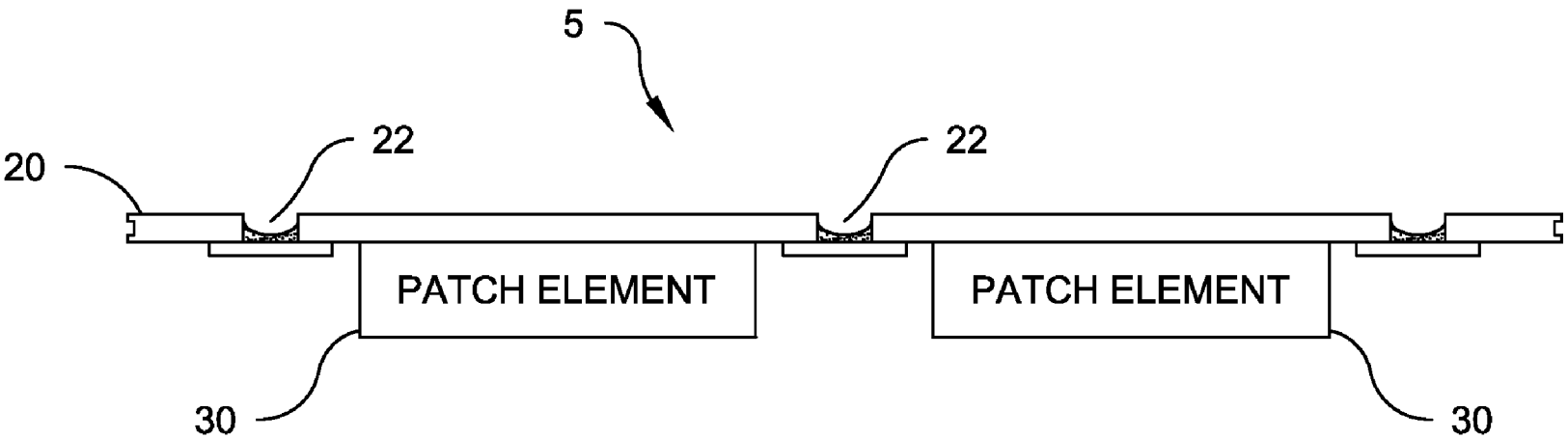
Fig. 1 (Prior Art)
FIG. 1 is a side view prior art configuration of two adjacent antenna patch elements.

The composite materials as embodied by non-conductive material layers 38, 39 serves to reduce the thickness of the overall patch element when compared to the prior art in FIG. 1. The interposition or embedding of the parasitic elements 44 into the layers 43 also serves to aid in the assembly of the phased array portion of the patch antenna by eliminating the requirement for (a) mounting holes to be placed into through the exterior surface of the enclosure and (b) subsequent sealing of the holes.

Another embodiment of the invention comprises a method of fabricating antenna elements wherein the method comprises the steps of fabricating the antenna 10 for transmitting and receiving radar signals comprising the steps of: covering the antenna face with a continuous layer 49 or 49*a* of a first non-conductive material; embedding parasitic element 44 into the interior layers of the first non-conductive material; embedding the electrical feed patch 46 into a layer of a second non-conductive material, and interfacing the first and second non-conductive materials. More particularly the method includes covering the phased array face 35 with a continuous layer of a non-conductive composite material, whereby the phased array antenna 10 is substantially impervious to disabling factors, such as weather, biological products, chemicals, mechanical assaults or undesirable incoming radiation; imbedding the parasitic element 44 between one or more of the layers 43 of the composite material.

Another embodiment of the method of fabricating antenna elements, includes embedding the electrical feed patch 46 into non-conductive foam or composite layered material 47, interfacing the composite materials with an optional separator sheet 48; and grounding a metallic cover 41 to enshroud the exposed five sides of the layer 47 of the electrical feed patch 46.

Referring again to FIG. 4, another embodiment of the invention includes a method of maintaining the embedded antenna 10 having the first non-conductive material cover 49*a* comprising the steps selected from one of (a) cleaning the cover 49*a* to remove contamination; (b) removing the cover 49*a* if contaminated; and/or (c) replacing the cover 49*a*.

While the foregoing invention has been described with reference to the above described embodiment, various modifications and changes can be made without departing from the spirit of the invention. Accordingly, all such modifications and changes are considered to be within the scope of the invention.

We claim:

1. An antenna system for transmitting and receiving radar signals having interconnecting joints comprising:

a first non-conductive composite material defining an outer cover for the antenna system and embedding a plurality of parasitic antenna elements, said material interfacing a second non-conductive material embedding a plurality of electrical feed elements;

wherein the first non-conductive material covers at least one interconnecting joint.

2. The antenna system of claim 1, wherein the first non-conductive material embedding the parasitic antenna element is separated by a dielectric material from the second material embedding an electrical feed element.

3. The antenna system of claim 1, wherein connection for the electrical feed elements extends through at least a portion of the second non-conductive material layer.

4. The antenna system of claim 1, wherein the electrical feed element is in electrical continuity with the associated radar system.

5. The antenna system of claim 1, wherein each embedded antenna element is disposed between materials of a different type.

6. The antenna system of claim 1, wherein each interconnecting joint forms a seam between parasitic antenna elements.

7. The antenna system of claim 6, wherein the first non-conductive composite material covers all of said plurality of electrical feed elements and all of said interconnecting joints in said antenna system.

8. The antenna system of claim 1, wherein each of the plurality of parasitic antenna elements abut the first non-conductive composite material on each of their sides.

9. An antenna for transmitting and receiving radar signals having feed interconnections comprising:

a non-conductive top cover interfacing a first set of non conductive material layers embedding a plurality of parasitic antenna elements, said first set of material layers interfacing a second set of material layers embedding a plurality of feed antenna elements, such that the top cover protects the feed interconnections from the environment.

10. The antenna of claim 9, wherein the material is one of graphitecarbon/epoxy, fiberglass/epoxy, and polyimide/epoxycarbon/polymide composite material.

11. The antenna of claim 9, wherein the parasitic element is chosen from a material selected from the group of aluminum copper, brass, or copper alloy.

12. The antenna of claim 9, wherein the cover forms a first non-conductive material layer separate and distinct from the first and second sets of non-conductive material layers.

13. The antenna of claim 9, wherein the cover is composed of a material different from the first and second sets of non-conductive material layers.

14. The antenna of claim 13, wherein a bonding material secures the cover to the first set of non conductive material layers.

15. The antenna of claim 9, wherein the cover material is selected from one of the group of acrylic, polyester, polyethylene, epoxy resins and aramid fiber.

16. The antenna of claim 9, wherein the cover is removable or replaceable.

17. A method of fabricating an embedded antenna for transmitting and receiving radar signals comprising the steps of:

embedding a series of antenna feed elements within corresponding non-conductive material layers separated via interconnecting joints defining an array pattern having a top most layer;

covering the top most layer of the non-conductive material layers with a continuous layer of a first non-conductive material having embedded therein corresponding parasitic antenna elements;

wherein the continuous layer covers the interconnecting joints.

18. The method of claim 17, wherein the continuous layer of said first non-conductive material is a composite material.

19. The method of claim 18, wherein the continuous layer is removable.

20. The method of claim 19, wherein the composite material comprises graphite/epoxy.

* * * * *